United States Patent [19]

Potts, Jr.

[11] 4,413,595

[45] Nov. 8, 1983

[54] DIESEL LOCOMOTIVE FUEL SAVINGS AND PROTECTION SYSTEM

[76] Inventor: John E. Potts, Jr., 4547 Beacon Ct., Decatur, Ill. 62521

[21] Appl. No.: 378,527

[22] Filed: May 17, 1982

[51] Int. Cl.[3] ..... F02N 17/02; F02B 77/08

[52] U.S. Cl. ..... 123/142.5 R; 123/179 BG; 123/179 H; 123/41.15; 123/198 D

[58] Field of Search ..... 123/142.5 R, 179 BG, 123/179 H, 41.15, 198 D

[56] References Cited

U.S. PATENT DOCUMENTS

| | | | |
|---|---|---|---|
| 1,081,683 | 12/1913 | Lurie | 123/179 H |
| 1,269,637 | 6/1918 | Olmsted | 123/179 H |
| 1,287,266 | 12/1918 | Eberly | 123/142.5 R |
| 1,293,569 | 2/1919 | Stein | 123/142.5 R |
| 2,373,735 | 4/1945 | Alexander | 123/179 BG |
| 2,691,110 | 10/1954 | Lincoln | 123/179 BG |
| 3,154,689 | 10/1964 | Bubbenmoyer | 123/179 BG |
| 3,172,400 | 3/1965 | Hale | 123/179 BG |

*Primary Examiner*—Ira S. Lazarus

*Attorney, Agent, or Firm*—Kalish & Gilster

[57] ABSTRACT

A system provides automatic starting of a locomotive diesel engine if the temperature drops toward freezing, which could damage the engine because of its water cooled nature, thereby saving fuel otherwise required when an engine is permitted to run continuously. Temperature sensing devices sense the temperature in the cooling water to sense a starting temperature, a shut-off temperature and a still lower temperature at which to provide an audible warning and drain the cooling water if freezing should be imminent. A circuit including a time delay relay is responsive to the sensing of the temperature at which starting is to be carried out for causing connection of the normally disconnected battery and energizing of the engine starter to initiate engine operation. This causes increase in the cooling water temperature to the level at which operation may be discontinued when this temperature is sensed, a circuit arrangement causes a stopping mechanism of the engine to be operated by solenoid, whereupon the engine and cooling water temperature gradually decreases until finally reaching a point at which restart is initiated. The starting circuitry includes provision for attempting a predetermined number of starts and an arrangement for temporarily activating the low governor oil pressure reset mechanism of the locomotive to ensure starting. Provision is made for giving audible warning and energizing a water drain solenoid valve if freezing is imminent and the engine has failed to start.

10 Claims, 1 Drawing Figure

DIESEL LOCOMOTIVE FUEL SAVINGS AND PROTECTION SYSTEM

BACKGROUND AND SUMMARY OF THE INVENTION

The invention relates to diesel locomotives and, more particularly, to a system for protecting, and saving fuel consumed by, a diesel locomotive engine.

When diesel locomotives are out-of-service, it has been conventional practice to run the engines of locomotive units full time during cool weather to prevent freezing of the cooling water and consequent damage to the engine as well as to avoid the difficulties of starting an engine when it is cool. This practice is extremely wasteful of fuel and consequently costly.

However, if the engine can be started and permitted to operate for a sufficient amount of time, its temperature will increase to a point at which cooling may occur over a considerable point before a restart will be necessary, owing to the large cooling water capacity and engine mass.

Accordingly, it is an object of the invention to provide a system for automatically starting of a diesel locomotive engine to maintain its temperature at or above a safe level.

It is an object of the invention to provide such a system which automatically provides unattended operation of such diesel locomotive engines only when necessary to maintain the engine temperature between first and second values and which will terminate engine operation when the temperature of the engine cooling water has reached a sufficient level.

It is also an object of the invention to provide such a system which avoids costly modification or redesign of engine control and electrical systems.

Another object of the invention is to provide such a system which allows normal deactivation or disconnection of the engine battery when the locomotive is out-of-service and which will automatically effectuate requisite reconnection of the battery for automatically starting the engine.

A further object of the invention is to provide such a system which will provide audible warning, upon the engine failing to start, if the temperature should fall to a level at which there would be danger from freezing.

A further object of the invention is to provide such a system which provides audible warning if the system is not activated upon the engine being placed out-of-service.

It is also an object of the invention to provide such a system which will automatically drain the cooling water if the temperature drops to a dangerous level.

A still further object of the invention is the provision of such a system which will automatically override the engine governor function which sometimes interferes with engine starting and which will, accordingly, provide for automatic actuation of the low governor oil pressure reset mechanism during engine starting.

It is an object of the invention also to provide such a system which can be installed on diesel locomotives easily and inexpensively either by retrofitting or during locomotive manufacture.

Other objects and features will be in part apparent and in part pointed out hereinbelow.

BRIEF DESCRIPTION OF THE DRAWING

The single FIGURE is a schematic circuit diagram in partly pictorial form, illustrating an automatic locomotive engine protection and fuel saving system constructed in accordance with and embodying the present invention.

DESCRIPTION OF THE PREFERRED EMBODIMENT

Figure 1:
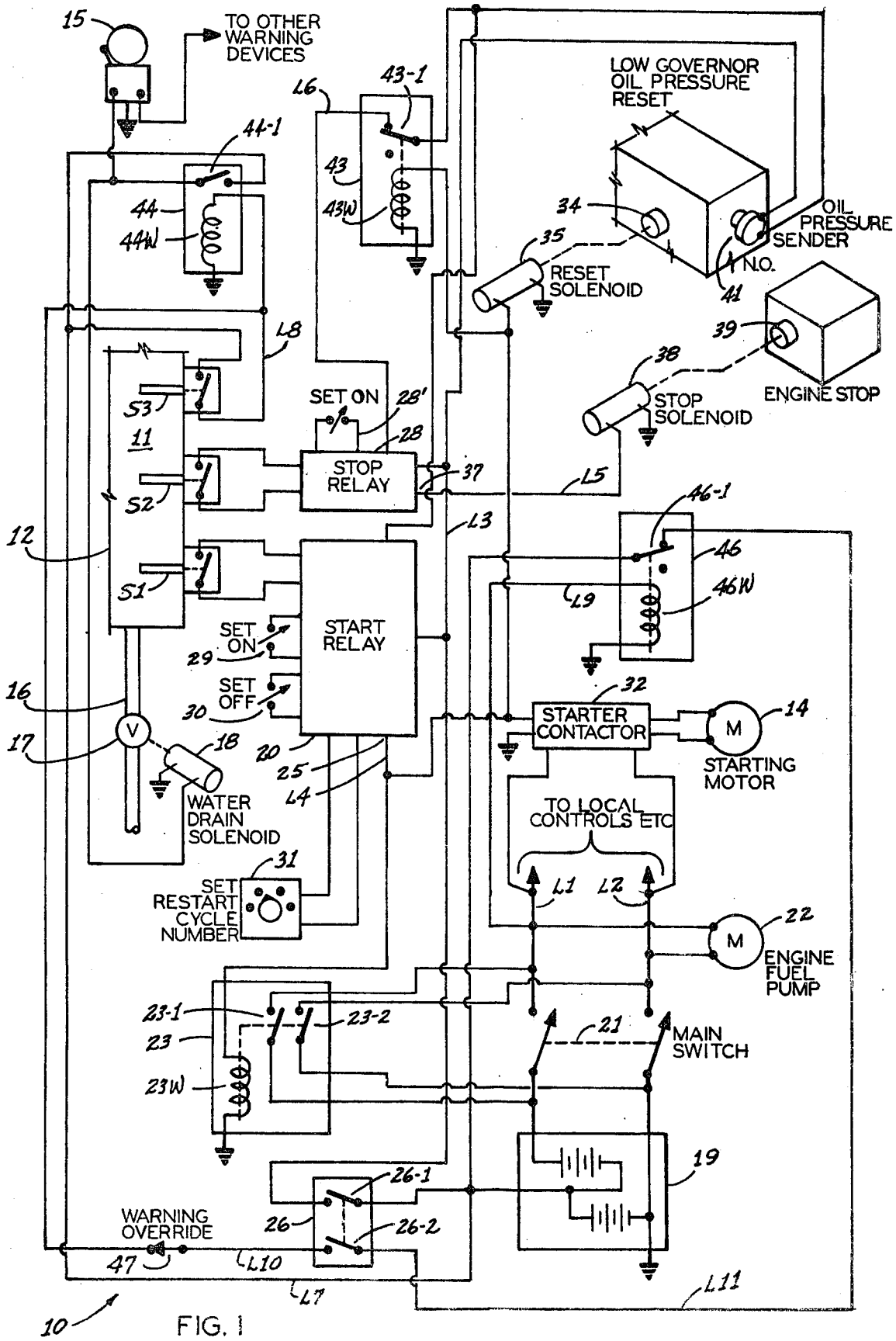

Referring now by reference characters to the drawings, there is designated generally at 10 a preferred embodiment of a fuel saver and protection system for diesel locomotive engines for automatic engine starting when the temperature drops below a point which it might be expected that freezing might occur. As is known, such engines are typically water cooled, it being therefore important to ensure that water in the cooling system will not freeze and thereby cause damage to the engine. These engines are of the type which conventionally power diesel-electric traction units in freight and passenger service.

At 11 is designated a body of cooling water contained within a suitable reservoir 12 from which cooling water is supplied during normal operation to the engine. A typical cooling water capacity for a diesel locomotive engine is 250 gallons. Conventionally, water is continuously circulated between the engine and reservoir 12 in a loop which includes suitable radiators (not shown). As a practical matter, it is uneconomical to add substantial amounts of ethylene glycol or other anti-freeze compounds to such a large volume of water. Accordingly, it has become common practice in some parts of the country to leave engines running over night as a precaution against the possibility that the temperature might fall below freezing, with consequent risk of extreme freezing damage to the engine, not to mention difficulty of starting.

Therefore, as a practical matter, these diesel units are usually run continuously in cool weather, even during fall and spring. During winter months, even though the temperature may rise above the freezing point in northern climates for a substantial part of the day, locomotive engines are always operated continuously even though the locomotive is not being utilized. This practice wastes enormous amounts of diesel fuel since even when not operating under load, fuel costs are several dollars per hour.

System 10 is designed for initiating operation of a starting motor 14 to initiate running of the diesel engines only when the temperature in reservoir 12 falls below a preselected value and for terminating operation of the engine when the body 11 of cooling water reaches a higher preselected value at which it may safely be shut off for a considerable period without risk of damage. Because of the large thermal mass of the engine and body of cooling water, the temperature will drop only gradually over a rather considerable period of time. A period of hours may then elapse before the water has cooled to the temperature at which starting should be initiated, whereupon a restart is effected by the system.

Briefly, a first temperature sensor S1 is utilized to initiate starting, a second sensor S2 is utilized to terminate running in response to sensing of the higher temperature, and a third sensor S3 is employed for initiating operation of a warning bell 15 or other warning device should the temperature drop below a still lower level at which freezing would be imminent upon continued dropping of the water temperature.

Also, to further protect against freezing of the cooling water 11, reservoir 12 is provided conventionally with a drain 16 equipped with a drain valve 17. In accordance with this invention, a solenoid 18 is used to open valve 17 in response to the sensing of a dangerously low temperature by sensor S3 and thereby drain the water 11 from reservoir 12 to prevent damage to the engine.

The electrical system of diesel locomotives typically includes a large lead-acid cell battery 19 capable of providing voltage for energization of field windings of the generator unit of the locomotive, and for supplying voltage to various so-called local controls and the like which are a part of the circuitry of the locomotive.

System 10 includes a start relay 20 adapted for being powered by battery 19 for the purpose of automatically initiating starting of the locomotive engine in response to sensor S1. Conventionally, a heavy duty two pole switch 21 is provided for the purpose of completely disconnecting battery 19 from the local controls and other circuitry of the locomotive when it is not in use. Therefore, after the operator stops the engine, switch 21 is opened manually by the operator to disconnect battery 19 from all engine circuits. Since the engine fuel pump 22 is connected across leads L1, L2 which connect with the output side of switch 21, the engine normally could not be started without closing switch 21. The new system 10 is provided with a contactor 23 having contacts 23-1 and 23-2 which are connected across the two poles of switch 21. A winding 23W of this contactor is connected with start relay 20 for being energized to close contacts 23-1 and 23-2 and thereby automatically interconnecting battery 19 with the engine circuits, energizing the engine fuel pump 22, irrespective of the position of switch 21 which will, of course, typically be open if the locomotive is out of service and its engine previously has been stopped.

Start relay 20 may be a conventional type of solid state time delay type adapted for providing a signal at its output 25 upon the closing of the normally open (n.o.) switch contacts of sensor S1 interconnected with relay 20. Power for operation of relay 20 is provided by a lead L3 through operation of a switch 26 having a first section 26-1 connected to battery 19 to enable operating voltage to be provided on lead L3 when the locomotive is shut down. Upon operator actuation of switch 26, contacts 26-1 will close to make voltage available for relay 20. Lead L3 is also interconnected with a solid state relay 28 which is interconnected with the n.o. contacts of sensor S2, for purposes explained hereinbelow. A stop relay 28 is responsive to sensor S2 contact closure for terminating operation of the engine. Stop relay 29 may be of conventional solid state time delay type so that its output will be provided only for a time interval established by control means 28'.

Relay 20 is provided with first control or adjustment means 29 for setting the interval during which the output 25 of relay 20 is energized or high following the closure of the contacts of sensor S1. Also, relay 20 is preferably of the recycling type which will reinitiate operation, causing output 25 again to go high, after a further delay interval. A control 30 is used to establish the "off" interval prior to recycling. Suitable control means 31 (which may be stepping relay or counter, etc.) is suitably interconnected with relay 20 to permit the latter to recycle only a predetermined number of times, such as twice, etc. This ensures that attempts to start the engine will not be repeated indefinitely should it fail to start in response to operation of relay 20.

For effecting starting, relay output 25 is connected by means of lead L4 to a contactor 32 which operates to provide the voltage across leads L1 and L2 for energizing starting motor 14. When relay output 25 is high, contactor 32 causes the voltage provided across leads L1 and L2 (by closing of contacts 23-1 and 23-2) to be made available for energizing starting motor 14.

Control means 29 is, accordingly, seem to determine the interval during which the starting motor 14 will be energized, it being preferred to limit the cranking interval to a period such as three to five minutes to prevent overheating of the starting motor 14 and unnecessary depletion of battery 19.

Diesel engines of the type used in these locomotive units typically include an engine speed governor which is hydraulically responsive. At 33 is representatively illustrated the governor unit 33 of the locomotive. This unit includes a reset switch 34 which sometimes must be manually operated to permit the engine to be started in which case the operator must manually depress reset button 34 to permit engine starting. In accordance with this invention, a solenoid 35 is suitably interconnected directly or indirectly with reset button 34 for operation upon energization of the solenoid, thereby to ensure that starting will be accompanied automatically in response to operation of relay 20. For this purpose, lead L4 is also connected to reset solenoid 35. As is apparent, reset button 34 is operated each time the system initiates a starting cycle.

Sensor S2 has n.o. contacts which are adapted to close when the temperature reaches a sufficient level beyond which further engine operation is not needed and from which cooling may take place until sensor S1 once more detects a temperature at which engine operation is to be initiated. Stop relay 28 provides voltage at its output 37 when the sensor contacts close. The output voltage is maintained for a predetermined interval set by control 28' adequate to effect engine stopping. This output voltage is made available by a lead L5 to a solenoid 38 suitably interconnected, either directly or indirectly, with the engine to a stop. Otherwise, button 39 is normally manually actuated only. Also interconnected with relay 28 by lead L6 is an oil pressure sender 41 of conventional type having n.o. contacts which close in response to proper oil pressure developed in governor unit 33. One side of sender 41 is connected with lead L3 so that battery voltage is supplied to a lead L6 if, during operation, oil pressure should fail to be developed by governor unit 33 whereby continued safe operation of the engine should not be permitted. In this way, relay 28 will terminate engine operation if oil pressure should drop below a predetermined threshold determined by sender 41. It will be noted that lead L6 is connected through the n.c. contacts 43-1 of a contactor 43 whose winding 43W is adapted to be energized by the voltage present on lead L4 during engine starting. Accordingly, contact 43-1 opens when starting takes place to preclude stop relay 28 from energizing the stop solenoid 38 and so preventing engine starting.

Sensor S2 has n.o. contacts which are connected for receiving voltage from a lead L7 connected to battery 19 on the battery side of switch contacts 26-1, being thereby always energized. Sensor S3 may be set to cause its contacts to close when the temperature falls below 34° F., for example, and so provide battery potential via a lead L8 to the winding 44W of a contactor 44. The latter has n.o. contacts 44-1 which are connected with lead L7 to provide the battery potential to bell 15 and to other warning devices, which then will be actuated should the temperature in the cooling water 11 fall to a value at which freezing would be imminent.

The system is also provided with means for ensuring that bell 15 and other warning devices will be actuated in the event the engine is shut down but an operator inadvertently fails to energize the new system by actuating switch 26. For this purpose, there is provided a contactor 46 having a winding 46W which is connected by lead L9 to the main power lead L1 from main switch 26. This contactor has n.c. contacts 46-1 which will open only when voltage is present on lead L1, as may occur only when main switch 21 is closed or contactor 23 is energized by start relay L4. If switch 26 is not actuated, its contacts 26-2, being of the normally closed type, will provide battery voltage through a lead L10 to energize contactor winding 44W and thereby actuate warning bell 15 and other warning devices. In this way, the operator is immediately alerted to the fact that switch 26 has not been actuated for enabling system operation. However, a manual warning override switch 47 is provided to open line L10 for preventing operation of the warning system if it is desired to disable system 10, as during maintenance, testing and so forth.

What is claimed is:

1. A system for automatically protecting, and saving fuel consumed by, an out-of-service diesel engine of a locomotive having a liquid cooling system for said engine and a battery for electrical power supply, said battery being normally electrically disconnected while said engine is out of service, said system comprising temperature sensing means for sensing the temperature of cooling liquid in said cooling system and for providing a first switching function when the sensed temperature falls to a first preselected value above the freezing point of said cooling liquid, a second switching function when the sensed temperature climbs to a second preselected value higher than said first value, and a third switching function if the sensed temperature falls to a third preselected value lower than said first valve but closer to said freezing point;

first circuit means responsive to said first switching function for electrically reconnecting said battery and for energizing a starter for said engine to initiate operation of said engine for producing increase of said temperature;

second circuit means responsive to said second switching function for energizing a stopping mechanism for said engine to terminate operation thereof;

an audible warning device; and protection circuit means responsive to said third switching function for initiating operation of said warning device;

whereby operation of said engine normally will be automatically effected intermittently to maintain said temperature between said first and second values but said warning device will be operated if operation of said engine is not automatically initiated.

2. An automatic system according to claim 1 and further characterized by a solenoid-actuated drain valve for permitting draining of said cooling liquid, said drain valve being actuated by said protection circuit means for draining said cooling liquid responsive to said third switching function, thereby to prevent freezing of said cooling liquid.

3. An automatic system according to claim 2 and further characterized by a control switch for said system for selectively enabling operation thereof, and circuit means responsive to the disconnection of said battery and to the condition of said control switch for initiating operation of said warning device if said battery is disconnected without said control switch being operated to enable operation of said system.

4. An automatic system according to claim 1 and further characterized by said first circuit means being operative to sense the initiation of the operation of said engine and including means for re-energizing said starter for a predetermined number of times if operation of said engine is not initiated responsive to said first switching function.

5. An automatic system according to claim 4 and further characterized by said first control means being operative to energize said starter only for a predetermined time interval and for delaying re-energizing of said starter for a further predetermined time interval.

6. An automatic system according to claim 5 and further characterized by said locomotive having a manually actuatable stop mechanism, said circuit means including solenoid means for actuating said stop mechanism in response to said second switching function.

7. An automatic system according to claim 6 and further characterized by said second circuit means providing a time delay function for maintaining energization of said stop solenoid for a predetermined time interval in response to said second switching function.

8. An automatic system according to claim 1 and further characterized by said first circuit means including a contactor adapted for reconnecting said battery in response to said first switching function and for subsequently disconnecting said battery upon operation of said engine being initiated.

9. An automatic system according to claim 1 and further characterized by said engine having a governor oil pressure reset mechanism adapted for being manually actuated to permit reset during starting of said engine, and solenoid means for actuating said reset mechanism when energized, said solenoid means being energized by said first circuit means responsive to said first switching function, whereby low governor oil pressure will not preclude automatic starting of said engine by said system.

10. An automatic system according to claim 9 and further characterized by low governor oil pressure sensing means, said second circuit means being responsive to said pressure sensing means during operation of said engine for energizing said stopping mechanism.

* * * * *